US005115108A

United States Patent [19]

Ogawa et al.

[11] Patent Number: 5,115,108

[45] Date of Patent: May 19, 1992

[54] TWO-STAGE RUBBER SWITCH

[75] Inventors: Kikuo Ogawa; Kazuya Arai, both of Shizuoka, Japan

[73] Assignee: Yazaki Corporation, Japan

[21] Appl. No.: 654,547

[22] Filed: Feb. 13, 1991

[30] Foreign Application Priority Data

Feb. 14, 1990 [JP] Japan ..... 2-12711[U]
Feb. 14, 1990 [JP] Japan ..... 2-31522

[51] Int. Cl.[5] ..... H01H 9/26; H01H 1/10

[52] U.S. Cl. ..... 200/1 B; 200/5 A; 200/512

[58] Field of Search ..... 200/1 B, 5 R, 5 A, 512, 200/517, 513, 514, 515, 516

[56] References Cited

U.S. PATENT DOCUMENTS 4,668,843 5/1987 Watanabe et al. ..... 200/5 A

*Primary Examiner*—Harold Broome
*Attorney, Agent, or Firm*—Wigman & Cohen

[57] ABSTRACT

The two-stage rubber switch comprises a housing; an operating knob; two push bodies slidably supported by the housing; a contact wiring board having four mutually-opposing contact end portions arranged two by two under each push body; a rubber switch member interposed between the housing and the contact wiring board and having four conductive contact pieces arranged so as to be opposed to the four mutually-opposing contact end portions, respectively on the contact wiring board; and two-stage switching members in particular, such as semispherical rubber buckling portions formed together with the rubber switch member or elastically slidable push members. Further, it is preferable to use some semispherical rubber buckling portions of the rubber switch member as click feeling providing members.

6 Claims, 9 Drawing Sheets

TWO-STAGE RUBBER SWITCH

BACKGROUND OF THE INVENTION

1. Field of the Invention

The present invention relates to a two-stage rubber switch suitable for use in automotive vehicle, for instance.

2. Description of the Prior Art

A number of various switches are generally used in various industrial fields without being limited to automotive vehicles; however, rubber switches are widely used in the automotive vehicle field, in particular from the standpoints of reliability, space, operability, etc.

FIG. 1(*a*) shows a power window switch for an automotive vehicle, by way of example of these rubber switches. This switch used to manually open or close a window glass is composed of a housing 101, a pair of push bodies 102 and 103, a contact wiring board 104, a rubber switch member 105, and a pivotal operation knob 106 on the push bodies. In operation, when the operation knob 106 is pivoted counterclockwise, for instance, the rubber buckling portion 108 of the rubber switch member 105 is pushed or buckled by the push body 102 to close a contact portion arranged on the contact wiring board 104, so that a window glass moves upward. In contrast, when the operation knob 106 is pivoted clockwise, since the rubber buckling portion 109 is buckled to close another contact portion, the window glass moves downward.

In the prior-art rubber switch as described, however, since the two contact portions are opened or closed at a single stage operation on each side, the window glass can be opened or closed only manually. Therefore, where automatic window glass opening/closing operation is further required, another similar switch must be provided in parallel to the manual switch as shown in FIG. 1(*a*). In other words, although this rubber switch is small in the number of parts, high in reliability and low in cost, there exists a problem in that a large space is required when two similar rubber switches are arranged side by side.

To overcome the above-mentioned problem, a two-stage operation power window switch is disclosed in Japanese Published Unexamined (Kokai) Utility Model Appli. No. 54-15278, as shown in FIG. 1(*b*). This two-stage operation switch is composed of a pivotal operation knob 121, a pair of first contact switches 122 and 123, and a pair of second contact switches 124 and 125. When the operation knob 121 is pivoted counterclockwise, for instance, the contact switch 122 is first closed and then the contact switch 124 is closed in sequence at two stage operation on each side, respectively.

In this prior-art two-stage operation switch, however, since the number of parts is large and further each switch is formed of a thin metallic plate, there exists a problem in that the assembly is not easy because fine adjusting work is inevitably required, so that the manufacturing cost is high and the reliability is low.

As described above, in the first prior-art rubber switch, although the reliability is high and the cost is low, there exists a problem in that the mounting space is not economized. Further, in the second prior-art two-stage switch, although the mounting space is small, there exist problems in that the reliability is low and the assembly cost is high.

SUMMARY OF THE INVENTION

With these problems is mind therefore, it is the primary object of the present invention to provide a two-stage rubber switch low in cost, high in reliability, and small in mounting space.

To achieve the above-mentioned object, the two-stage rubber switch according to the present invention, comprises: (a) a housing (1); (b) an operating knob (25) movably supported by said housing; (c) at least two push bodies (8, 9; 51, 61) slidably disposed at an interval within said housing, each of said push body being depressed whenever said operating knob is moved on either side; (d) a contact wiring board (14) having at least four mutually-opposing contact end portions (15*a*, 15*b*, 16*a*, 16*b*) arranged two by two under each of said two push bodies; (e) a rubber switch member (18, 56) interposed between said housing and said contact wiring board and having at least four conductive contact pieces (19*c*, 19*d*, 20*c*, 20*d*; 57*c*, 57*d*, 58*c*, 58*d*) arranged so as to be opposed to the four mutually-opposing contact end portions, respectively on said contact wiring board; and (f) two-stage switching means (21, 55) for urging said rubber switch member toward said contact wiring board, whenever said operating knob is moved, to bring the two conductive contact pieces of said rubber switch member into contact with the two opposed mutually-opposing contact end portions on said contact wiring board at two different strokes. The two-stage switching means (21) is at least four hemispherical rubber buckling portions (19*a*, 19*b*; 20*a*, 20*b*) formed together with said rubber switch member and located two by two under each of said two push bodies so as to be buckled at two different strokes by said push body moved by said operating knob or at least two push member (52, 62) each including a slider (52*a*, 62*a*) slidably housed within said housing and a compressive spring (52*b*, 62*b*) interposed between said slider and said rubber switch member.

Further, the rubber switch preferably comprises click feeling providing means (80) formed together with the rubber switch member (82) as rubber buckling portions (81) buckled when depressed by said push body moved by said operating knob.

In the two-stage rubber switch according to the present invention, since two different contacts are closed or opened at two different strokes by the two-stage switching means such as rubber buckling portions or elastically slidable push bodies, it is possible to simply realize two-stage switching operation in spite of a difference in stroke between the two different switches.

Further, when some rubber buckling portions are formed in the rubber switch member as click feeling providing means, it is possible to increase the click feeling load by two or more times, thus providing a more reliable switching operation.

BRIEF DESCRIPTION OF THE DRAWINGS

FIG. 1(*b*) is an illustration showing a second prior-art rubber switch;

FIG. 2(*b*) is a side cross-sectional view taken along the line 2B—2B shown in FIG. 2(*a*);

FIG. 7(*b*) is a similar side cross-sectional view taken along the line 7B—7B shown in FIG. 6;

FIG. 10(*b*) is a side cross-sectional view taken along the line 10B—10B shown in FIG. 10(*a*).

DETAILED DESCRIPTION OF THE PREFERRED EMBODIMENTS

Embodiments of the two-stage rubber switch according to the present invention will be described in more detail with reference to the attached drawings.

Figure 1A:
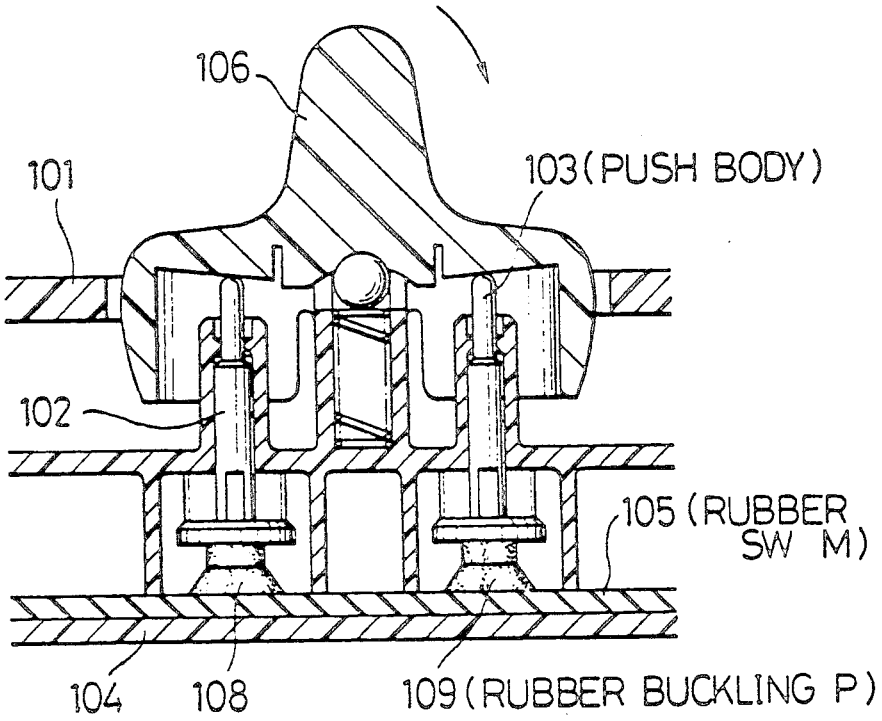
FIG. 1(a) PRIOR ART
FIG. 1(*a*) is a cross-sectional view showing a first prior-art rubber switch.
Figure 1B:
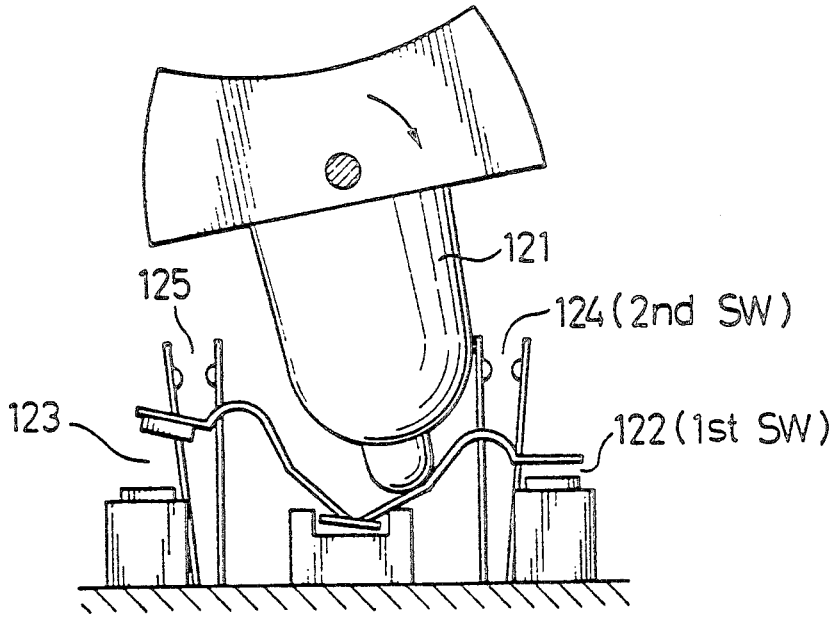
FIG. 1(b) PRIOR ART
Figure 2A:
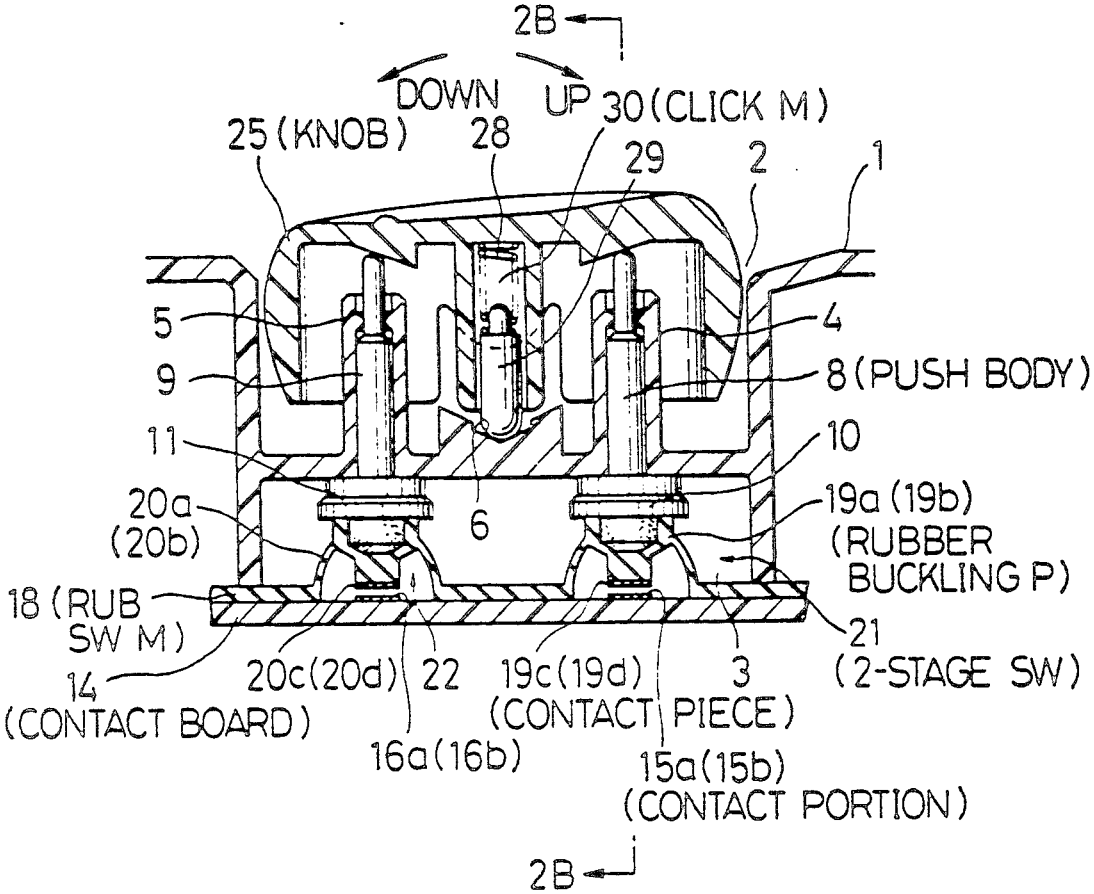
FIG. 2(*a* ) is a front cross-sectional view showing a first embodiment of the two-stage rubber switch according to the present invention.
Figure 2B:
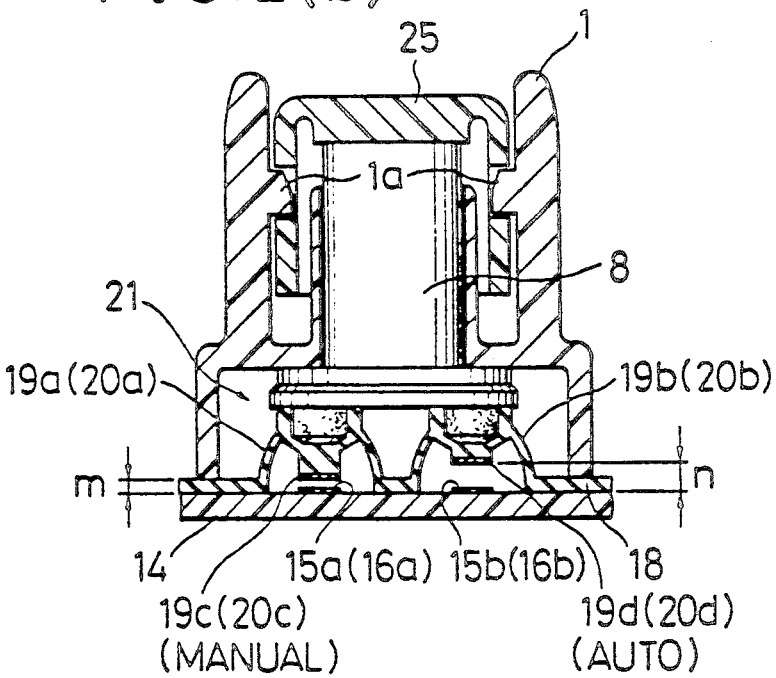

FIGS. 2(*a*) and 2(*b*) show a first embodiment thereof, in which FIG. 2(*a*) is a front cross-sectional view showing the essential composing elements thereof, and FIG. 2(*b*) is a cross-sectional view taken along the line 2B—2B shown in FIG. 2(*a*).

In FIGS. 2(*a*) and 2(*b*), two two-stage operation switches are incorporate, and therefore four contacts in all are arranged therein.

In FIG. 2(*a*), the two-stage rubber switch comprises a housing 1, two push bodies 8 and 9, a rubber switch member 18 and a contact wiring board 14. The housing 1 is formed with upper and lower openings 2 and 3 and two vertical guide portions 4 and 5 spaced away from each other, and a V-shaped groove 6 for providing a click feeling for an operation knob 25. A pair of push bodies 8 and 9 are slidably inserted into the vertical guide portions 4 and 5 of the housing 1, respectively. Each push body 8 or 9 is a flat plate member formed with a flat push portion 10 or 11 at each lower end thereof. The upper end portion of each flat push portion 10 or 11 serves as a stopper surface urged against the housing 1 and the lower end portion thereof serves as a push surface against the rubber switch member 18.

The contact wiring board 14 is attached to the lower opening 3 of the housing 1 with the rubber switch member 18 sandwiched therebetween. On the contact wiring board 14, there are arranged four contact portions 15*a*, 15*b*, 16*a* and 16*b* in such a way that first and second contact portions 15*a* and 15*b* are arranged under the first push portion 10 of the first push body 8 and third and forth contact portions 16*a* and 16*b* are arranged under the second push portion 11 of the second push member 9, respectively, as shown in FIGS. 2(*a*) and 2(*b*).

Figure 3:
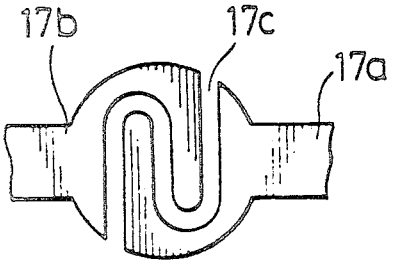
FIG. 3 is an enlarged plan view showing two opposing contact piece portion.

Further, as shown in FIG. 3, each contact portion 15*a*, 15*b*, 16*a*, and 16*b* is formed with two opposing roughly U-shaped conductive plate end portions 17*a* and 17*b* with a roughly S-shaped insulating space 17*c* formed between the two, so that the two conductive plate end portions 17*a* and 17*b* are electrically connected to each other when a conductive piece material is brought into pressure contact with these two conductive plate end portions 17*a* and 17*b* simultaneously.

A rubber switch member 18 is interposed between the contact wiring board 14 and the two push bodies 8 and 9. This rubber switch member 18 is provided with two roughly hemispherical rubber buckling portions 19*a* and 19*b* so as to be opposed to the two contact portions 15*a* and 15*b* and with two similar roughly hemispherical rubber buckling portions 20*a* and 20*b* so as to be opposed to the two contact portions 16*a* and 16*b*. Further, the four rubber buckle portions 19*a* and 19*b*, and 20*a* and 20*b* are formed with upper surfaces brought into contact with the two push bodies 8 and 9, and with lower conductive contact piece 19*c* and 19*d* and 20*c* and 20*d* brought into contact with the four contact portions 15*a*, 15*b*, 16*a* and 16*b*, respectively. Therefore, when each of these rubber buckling portions 19*a*, 19*b*, 20*a* and 20*b* is depressed by one of the push bodies 8 and 9, since each rubber buckling portion is elastically deformed or buckled, each conductive contact piece 19*c*, 19*d*, 20*c* or 20*d* is brought into pressure contact with the contact portion 15*a*, 15*b*, 16*a*, or 16*b*, respectively to close circuits formed on the contact wiring board 14. On the other hand, when the push body 8 or 9 is released, the circuits are opened.

Further, the rubber buckling portions 19*a* and 20*a* are of overstroke rubber buckling type, by which the rubber buckling portion 19*a* or 20*a* can be further depressed or buckled a little more stroke even after the contact pieces 19*a* and 20*c* have been brought into contact with the contact portions 15*a* and 16*b*, respectively. In more detail with reference to FIG. 2(*b*), the contact open distance is determined to be different between the rubber buckling portion 19*a* or 20*a* and the rubber buckling portion 19*b* or 20*b*; that is, a contact distance m of the rubber buckling portion 19*a* or 20*a* between the two contact portions 15*a* and 19*c* or 16*a* and 20*c* is determined smaller than a contact distance n of the rubber buckling portion 19*b*or 20*b* between the two contact portions 15*b* or 16*b* and 19*d* or 20*d*. Since the difference in stroke between the two rubber buckling portions 19*a* and 19*b* can be deformably absorbed by the hemispherical rubber shape, it is possible to realize, two-stage rubber buckling portions 19*a* and 20*a* according to two different stroke.

Further, the contact portion 15*a* is used to manually move a window glass, upward; the contact portion 15*b* is used to automatically move the window glass upward; the contact portion 16*a* is used to manually move the window glass downward; and the contact portion 16*b* is used to automatically move the window glass downward, by way of example. Therefore, the push body 8 is used to move the window glass upward, and the push body 9 is used to move the window glass downward, and the overstroke is used to move the window glass automatically.

Further, the operation knob 25 is pivotally supported on the upper opening 2 of the housing 1 by fitting two inner projections 1*a* of the housing 1 into two side holes of the knob 25, as shown in FIG. 2(*b*). A clicking means 30 composed of a pin 29 and a compressive spring 28 is disposed at the center of the operation knob 25, so that an appropriate click feeling can be obtained due to friction between the pin 29 and the V-shaped pin support groove 6. Therefore, when the knob 25 is pivoted clockwise, the push body 8 is depressed to move the window glass upward; and when pivoted counterclockwise, the push member 9 is depressed to move the window glass downward.

The operation of the first embodiment of the rubber switch as described above will be explained with reference to FIGS. 4(*a*), 4(*b*), 5(*a*) and 5(*b*).

Figure 4A:
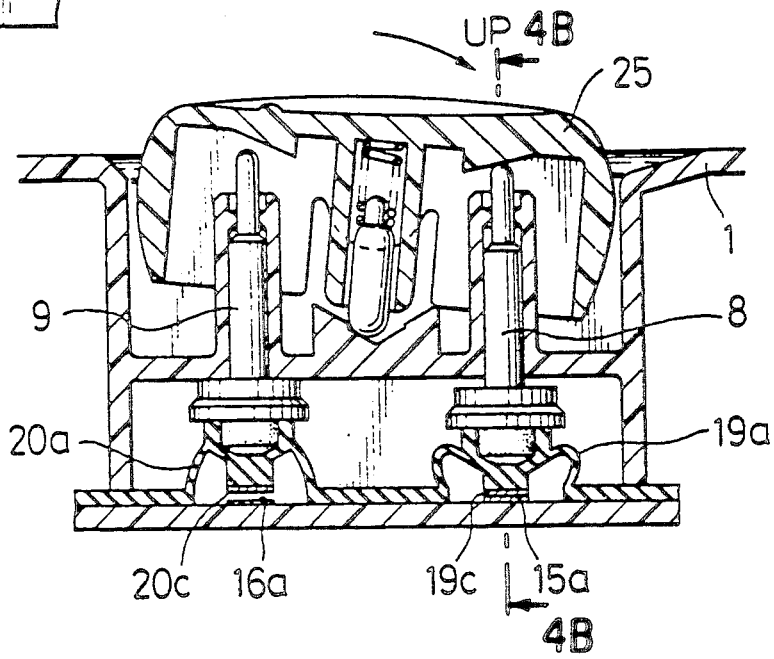
FIGS. 4(*a*) and 4(*b*) and FIGS. 5 (*a*) and 5(*b*) are cross-sectional views for assistance in explaining the two-stage switching operation thereof, which are similar to FIGS. 2(*a*) and 2(*b*)
Figure 4B:
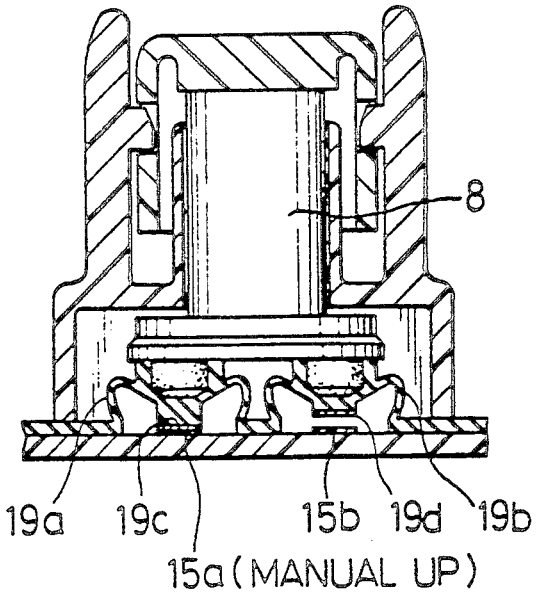

In FIGS. 4(*a*) and 4(*b*), when the operating knob 25 is pivoted clockwise, since the push body 8 is depressed downward, the conductive contact piece 19*c* is brought into contact with the manual upward-motion contact portion 15*a* at the first-stage switching operation, so that the window glass moves upward manually. When the operating knob 25 is released, since the operation knob 25 is pivoted counterclockwise, the conductive contact piece 19*c* is separated away from the contact portion 15*a*, so that the window glass stops moving upward.

Figure 5A:
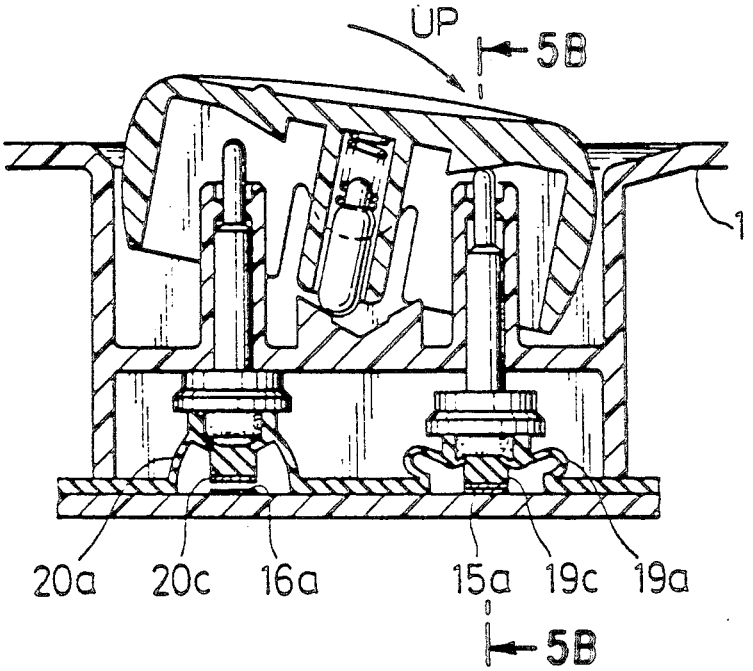
Figure 5B:
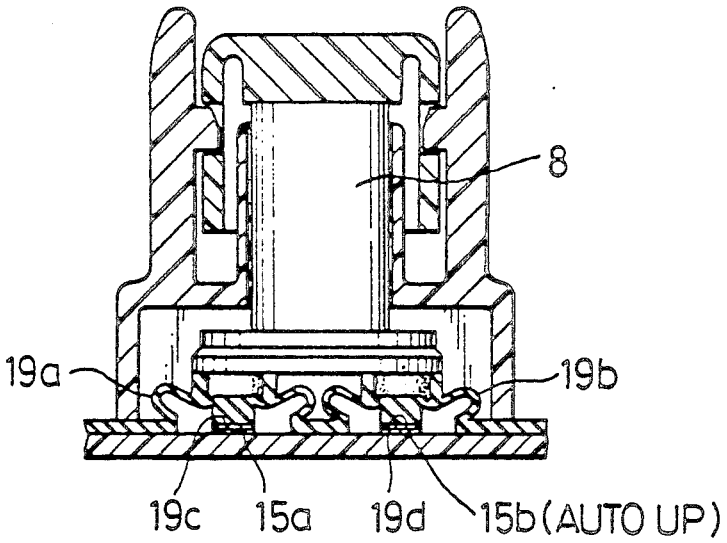

Further, where the operation knob 25 is pivoted clockwise, since the conductive contact piece 19*c* is brought into contact with the contact portion 15*a*, although the window glass starts moving upward, when the operation knob 25 is further pivoted clockwise, since the rubber buckling portion 19*a* of two-stage switching means 21 is further deformed (after the two contact portions 15*a* and 19*c* have been closed) and therefore the stroke difference between the two rubber buckling portions 19*a* and 19*b* can be absorbed, the rubber buckling portion 19*b* is further moved downward to bring the contact piece 19*d* into contact with the contact portion 15*b*. Therefore, the rubber switch is shifted to the second stage position, as shown in FIGS. 5(*a*) and (*b*), to automatically move the window glass upward.

In the same way when the operating knob 25 is pivoted counterclockwise, since the push body 9 is depressed downward, the conductive contact piece 20*c* is brought into contact with the manual downward-motion contact portion 16*a* at the first-stage switching operation, so that the window glass moves downward manually. When the operating knob 25 is release, since the operation knob 25 is pivoted clockwise, the conductive contact piece 20*c* is separated away from the contact portion 16*a*, so that the window glass stops moving downward.

Further, when the operation knob 25 is further pivoted counterclockwise, since the rubber buckling portion 20*a* of two-stage switching means 21 is further deformed (after the two contact portions 16*a* and 20*c* have been closed) and therefore the stroke difference between the two rubber buckling portions 20*a* and 20*b* can be absorbed, the rubber buckling portion 20*b* is further moved downward to bring contact piece 20*d* into contact with the contact portion 16*b*. Therefore, the rubber switch is shifted to the second stage position, to automatically move the window glass downward.

Figure 6:
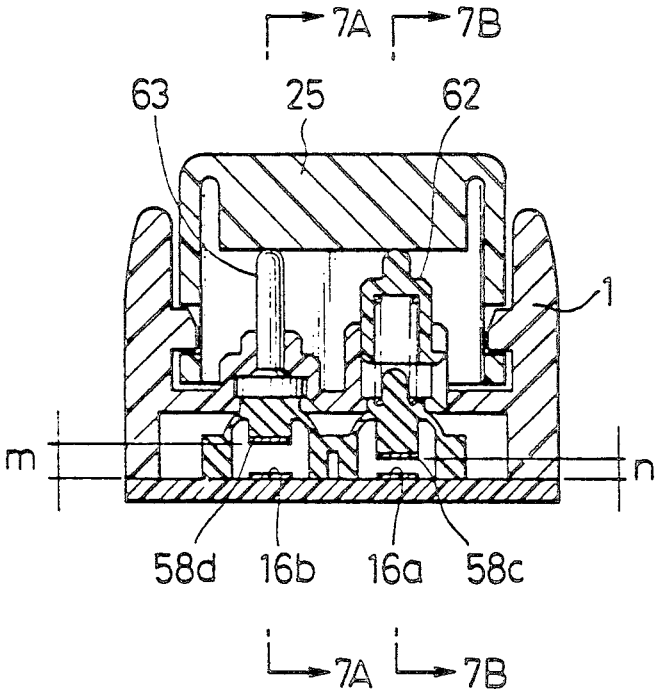
FIG. 6 is a front cross-sectional view showing a second embodiment of the two-stage rubber switch according to the present invention.
Figure 7A:
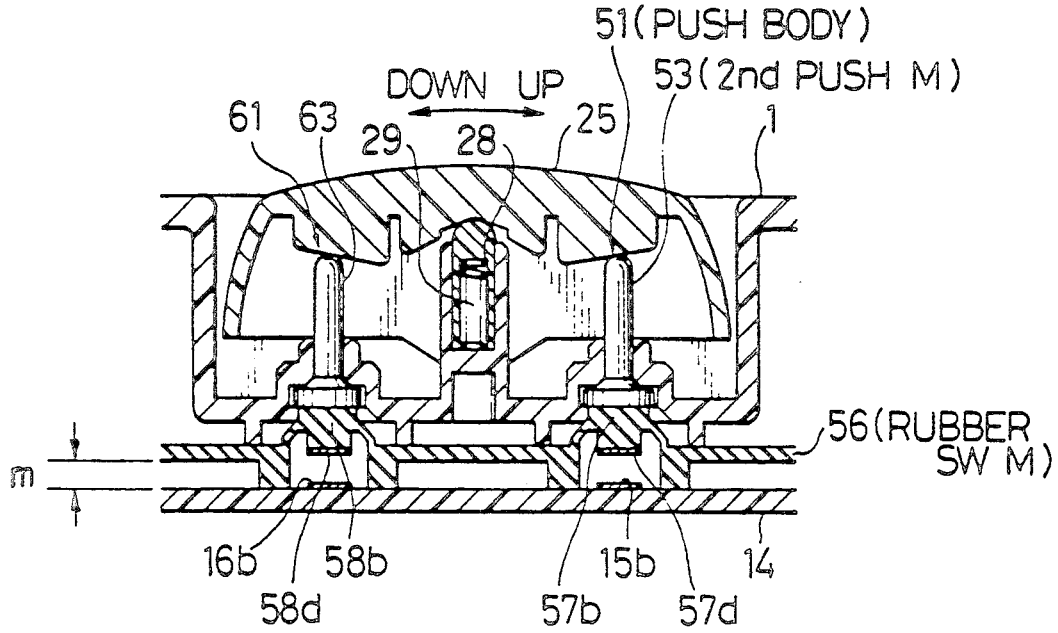
FIG. 7(*a*) is a side cross-sectional view taken along the line 7A—7A shown in FIG. 6.
Figure 7B:
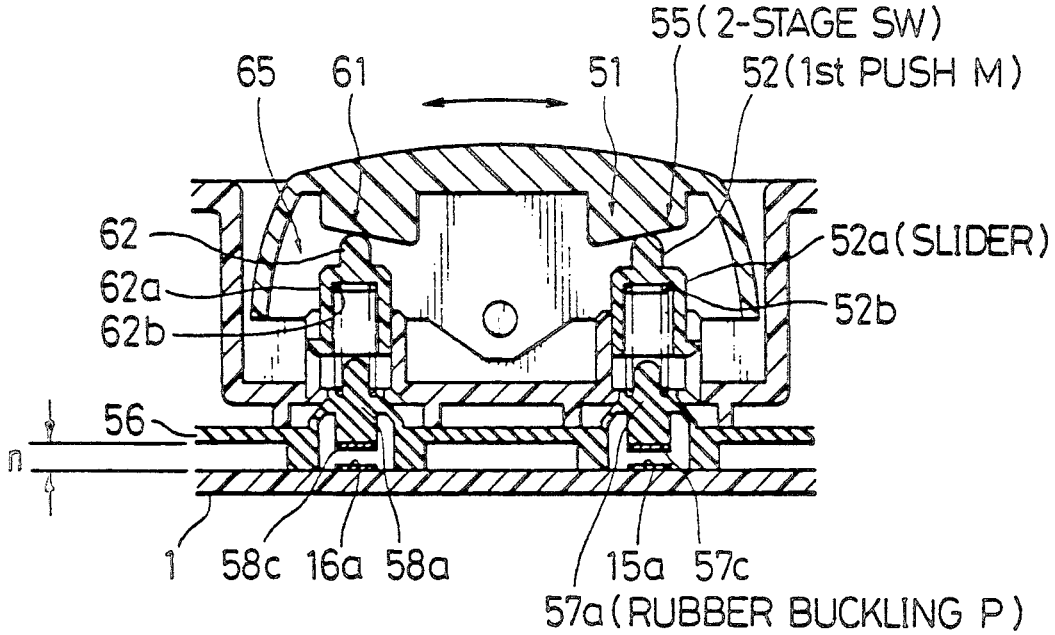

FIGS. 6, 7(*a*), 7(*b*), 8(*a*), 8(*b*), 9(*a*) and 9(*b*) show a second embodiment of the two-stage rubber switch according to the present invention. This embodiment is the same in structure as the first embodiment except for the push bodies and the two-stage operating means. That is, in this second embodiment, the two-stage switching means is composed of a slider and a coil spring to absorb the stroke difference, instead of the rubber buckling portions. Therefore, the same references have been retained for similar parts which have the same functions and any detailed description of them is omitted herein.

FIG. 6 is a front cross-sectional view showing the second embodiment; FIG. 7(*a*) is a cross-sectional view taken along the line 7A—7A in FIG. 6. FIG. 7(*b*) is a cross-sectional view taken along the line 7B—7B in FIG. 6; and FIGS. 8(*a*) and 8(*b*) and FIGS. 9(*a*) and 9(*b*) are cross-sectional views for assistance in explaining the operation thereof.

With reference to FIGS. 6 to 7, an operation knob 25 is pivotally mounted on the upper opening of a housing 1. Within the housing 1, a push body 51 for moving a window glass upward and a push body 61 for moving the same downward are slidably provided. The first push body 51 is composed of a first push member 52 constituting 2-stage switching means 55 and a rod-shaped second push member 53. The first push member 52 is composed of a slider 52*a* and a coil spring 52*b*. The slider 52*a* is slidably supported within the housing 1 and formed with a side projection engaged with a vertical housing groove of the housing 1 so as not to be rotated. This first push member 52 pushes a rubber buckling portion (described later) via the coil spring 52*b*. The difference in switch operation stroke between the two stages can be absorbed by the expansion and compression of this spring 52*b*.

In the same way, the push body 61 is composed of a first push member 62 constituting two-stage switching means 55 and a second rod-shaped push member 63. The first push member 62 is composed of a slider 62*a* and a coil spring 62*b*.

In the same way as in the first embodiment, a contact wiring board 14 and a rubber switch member 56 are provided at the lower opening of the housing 1.

A manual upward-movement contact 15*a* is arranged under the first push member 52; an automatic upward-movement contact 15*b* is arranged under the second push member 53; a manual downward-movement contact 16*a* is arranged under the first push member 62; and an automatic downward-movement contact 16*b* is arranged under the second push member 63, as shown in FIGS. 7(*a*) and 7(*b*).

Further, the rubber buckling portion 57*a* or 58*a* is disposed under the first push member 52 or 62, and the rubber buckling portion 57*b* or 58*b* is disposed under the second push member 53 and 63, respectively. Further, the switch operation stroke n of the conductive contact pieces 57*c* and 58*c* of the rubber buckling portions 57*a* and 58*a* is determined to be smaller than that m of the conductive contact pieces 57*d* and 58*d* of the rubber buckling portions 57*b* and 58*b*.

Figure 8A:
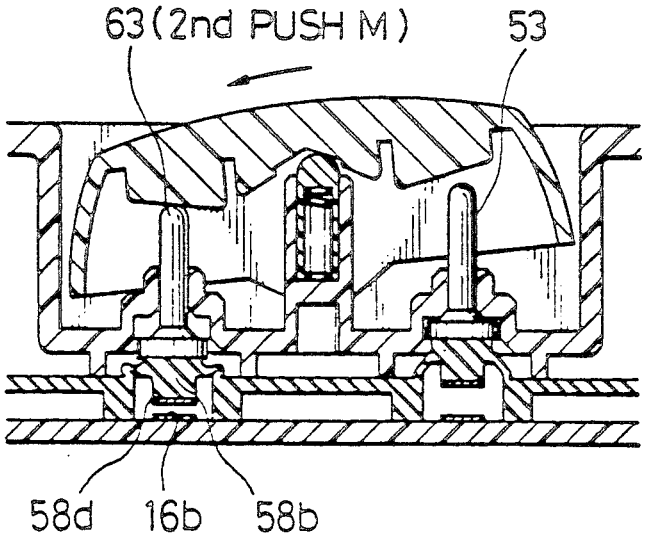
FIGS. 8(*a*) and 8(*b*) and FIGS. 9(*a*) and 9(*b*) are cross-sectional views for assistance in explaining the two-stage switching operation thereof, which are similar to FIGS. 7(*a*) and 7(*b*)
Figure 8B:
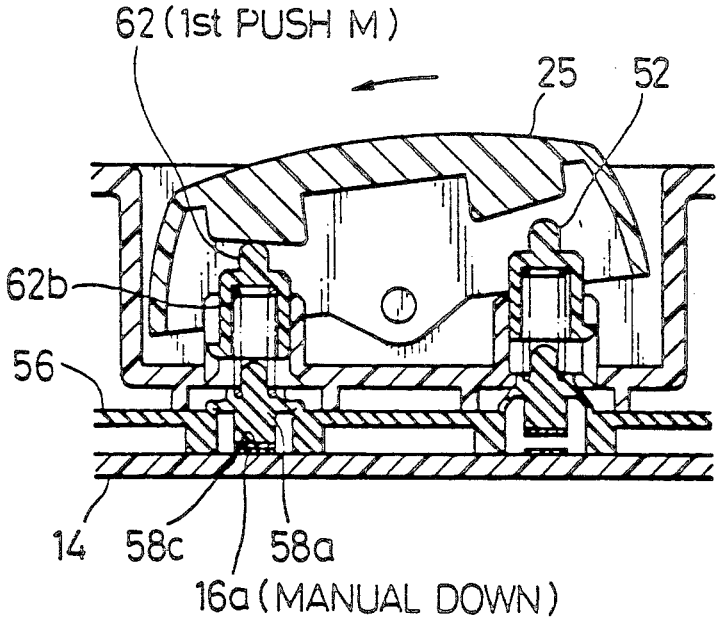
Figure 9A:
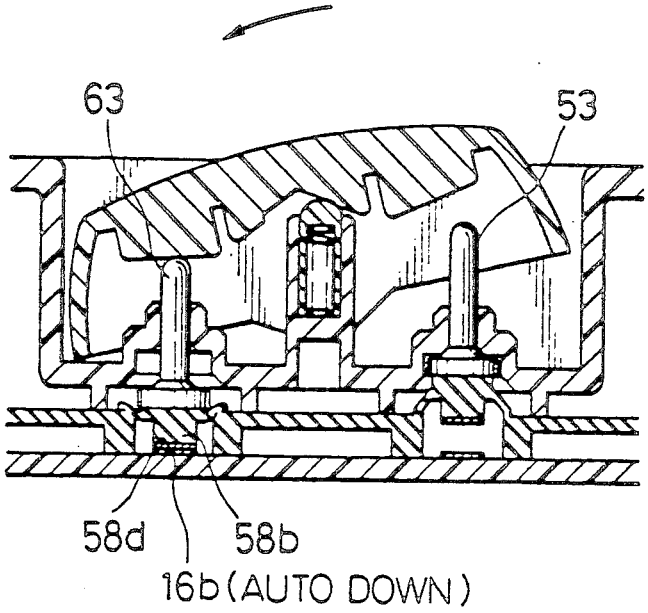
Figure 9B:
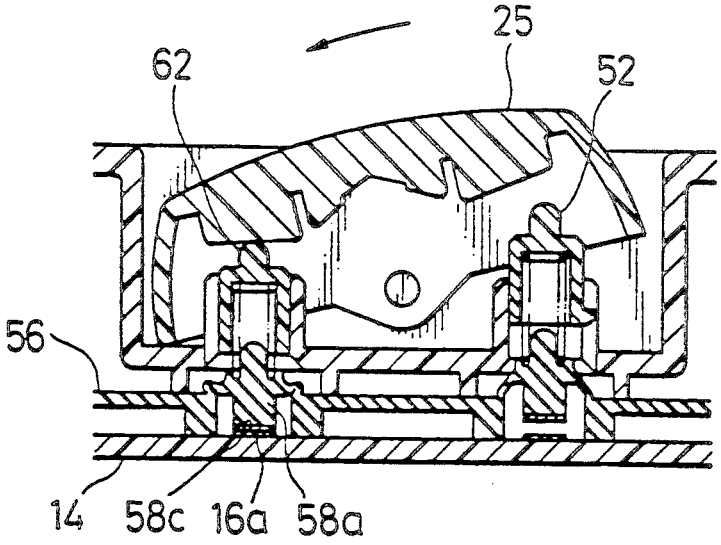

In operation, when the operation knob 25 is pivoted counterclockwise in FIGS. 8(*a*) and 8(*b*), since the conductive contact piece 58*c* of the first push member 62 of the downward-movement push body 61 is brought into contact with the contact portion 16*a* to perform manual window downward operation. This first-stage switching operation is shown in FIGS. 8(*a*) and 8(*b*). When the operation knob 25 is further pivoted counterclockwise, since the second push member 63 moves downward and further the spring 62*b* of the first push member 62 is compressed to absorb the stroke difference, the conductive contact piece 58*d* of the second push member 63 is brought into contact with the contact portion 16*b* to perform automatic window downward operation. This second-stage switching operation is shown in FIGS. 9(*a*) and 9(*b*).

Further, in the above embodiments, although the two-stage switching means is composed of an over-stroke rubber buckling portion or a coil spring, it is possible to adopt any means for absorbing a stroke difference, without being limited thereto. Further, the rubber switch of the present invention is of course usable for applications other than the automotive vehicle power window.

As described above, in the present invention, a pair of push bodies are disposed within a housing; two conductive contact pieces are provided for each push body; two rubber buckling portions having a switch stroke difference are disposed for each of these two conductive contact pieces; and further two two-stage switching means for absorbing the stroke difference between the two-stage switching means are provided, it is possible to open or close four switches, independently. Therefore, it is possible to reduce the mounting space in addition to high reliability and low cost, as compared with the prior-art rubber switch.

Figure 10A:
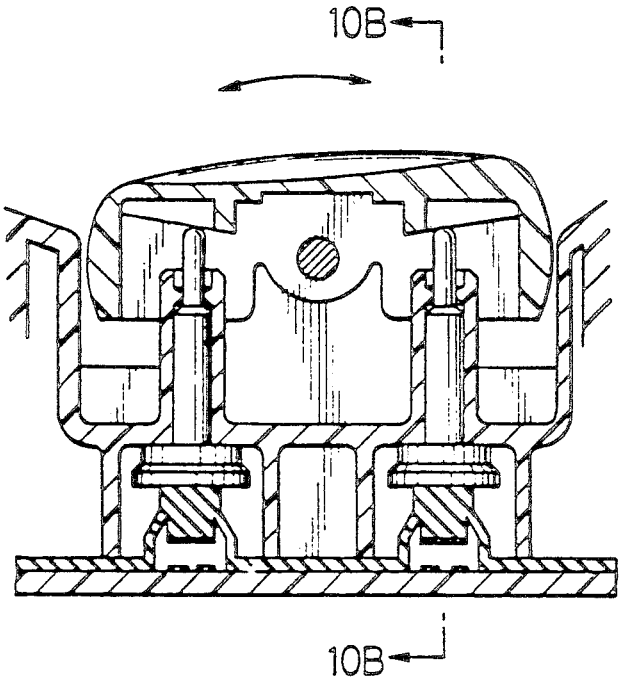
FIG. 10(*a*) a front cross-sectional view showing a third embodiment of the rubber switch according to the present invention.

FIGS. 10(*a*) and 10(*b*) show a third embodiment of the two-stage rubber switch according to the present invention. The feature of this third embodiment is to use at least one rubber buckling portion of the rubber switch member as click feeling means for providing a more reliable switching feeling for the operator.

In the rubber switch, since a moment or a pivotal motion required to turn on or off the rubber switch is relatively small, it is preferable to provide a secure click feeling for the rubber switch in the manual switching operation, in particular, in order to allow the operation to be able to confirm the switching operation. In the afore-mentioned embodiments, the click feeling providing means is usually composed of a pin 29 and a compressive coil spring 28 as shown in FIG. 2(*a*) or FIG. 7(*a*), so that an appropriate click feeling can be obtained on the basis of the frictional force generated between the end of the pin 29 urged by the spring 28 against a U-shaped groove formed near the middle portion of the housing 1 (in FIG. 2*a*) or of the operation knob 25 (in FIG. 7*a*). However, the above-mentioned click feeling providing means is large in the number of parts, complicated in structure and therefore assembly process.

Figure 10B:
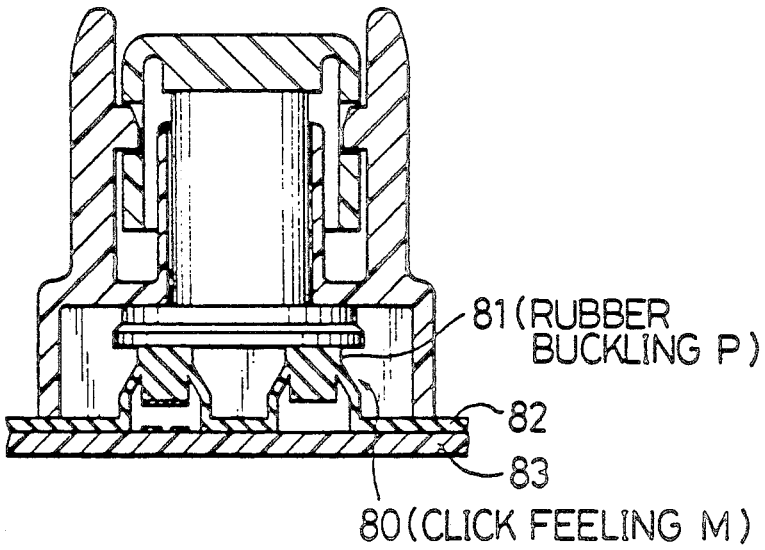

In the third embodiment shown in FIGS. 10(*a*) and 10(*b*), at least one 81 of a plurality of rubber buckling portion 81 (as shown in FIG. 10*b*) of the rubber switch member 82 is used in common as a click feeling providing member 80 without providing any conductive contact piece on the surface brought into contact with the contact wiring board 83. In other words, since no conductive contact piece is attached to the lower surface of the rubber buckling portion 81 of the rubber switch member 82, even when the rubber buckling portion 81 is buckled against the contact wiring board 83, this buckling operation will not serve as a rubber switch, but serves as a secure click feeling providing member when depressed. For instance, if the switching operation load for each rubber buckling portion is 250 g, it is possible to double the switching operation load up to 500 g, when four rubber buckling portions are provided two by two on either side.

In the case of the rubber switch shown in FIGS. 10(*a*) and 10(*b*), only a single rubber buckling portion 81 is provided for each push body of the rubber switch provided with four rubber buckling portions, by way of example. Without being limited thereto, however, it is of course possible to increase the number of the push body, the number of the rubber buckling portions provided with conductive contact pieces, respectively and further the number of the rubber buckling portions provided with no conductive contact pieces so as to be usable as click feeling providing means. Further, it is also possible to attach a conductive contact piece to the lower surface of the rubber buckling portion used as the click feeling providing means, provided that no contact portions are arranged on the contact wiring board 83 at the position just under the rubber buckling portion used as the click feeling providing means.

As described above, in the present invention, since the rubber buckling,. portion not opposing to contact portions are used as click feeling providing means, it is possible to provide a rubber switch provided with an appropriate click feeling without increasing the number of parts. Since the rubber switch is formed by molding, the additional formation of the rubber buckling portions may not increase the manufacturing cost, thus providing a low-cost rubber switch.

Further, the present invention has been explained of the two-stage rubber switch. Without being limited thereto, however, it is also possible to apply the present invention to three or more stage rubber switch for closing/opening three or more contacts at three or more different strokes.

What is claimed is:

1. A two-stage rubber switch, comprising:

(a) a switch housing;

(b) a pivotal operating knob pivotally supported by said switch housing;

(c) at least two push bodies slidably disposed at an interval within said housing, one of said push bodies being depressed whenever said operating knob is pivoted to either side.

(d) a contact wiring board having at least four mutually-opposing contact end portions arranged two by two under each of said two push bodies; and (e) a two-stage rubber switching member interposed between said two push bodies and said contact wiring board, said rubber switching member having:

(1) at least four roughly hemispherical rubber buckling portions located two by two under each of said two push bodies and formed with four upper surfaces brought into contact with said push bodies two by two, respectively, when said push bodies are depressed when said operating knob is pivoted to either side, and four lower surfaces two of which are two different stroke distances away from said contact wiring board, respectively; and (2) at least four conductive contact pieces fixed to said four lower surfaces of said buckling portions, respectively, so as to be brought into contact with the four contact end portions on said contact wiring board two by two, respectively, at two different stroke distances by said push body depressed by said pivotably operating knob.

2. The two-stage rubber switch of claim 1, wherein each of said two push bodies comprises:

(a) a first push member having:

(1) a slider slidably supported by said switch housing; and (2) a coil spring for urging said slider against said switch housing so as to absorb a first stroke difference and to cause conductive contact between at least two contact end portions; and (b) a second push member slidably supported by said switch housing, the second push member being urged through a second stroke difference to cause conductive contact between an additional two contact end portions.

3. The two-stage rubber switch of claim 1, wherein the two-stage rubber switch is a pivoting vehicle window glass moving switch for opening a vehicle window glass manually at a first stroke switching operation corresponding to a first operating knob pivoting position and automatically at a second stroke switching operation corresponding to a second operating knob pivoting position when said operating knob is pivoted in a first direction, and for closing the vehicle window glass manually at a first stroke switching operation corresponding to a first operating knob pivoting position and automatically at a second stroke switching operation corresponding to a first operating knob pivoting position and automatically at a second stroke switching direction opposite to the first direction.

4. The two-stage rubber switch of claim 1, which further comprises click feeling providing means formed together with said rubber switching member.

5. The two-stage rubber switch of claim 4, wherein said click feeling providing means is a hemispherical rubber buckling portion buckled when depressed by said push body moved by said operating knob.

6. The two-stage rubber switch of claim 1, wherein the two-stage rubber switch is a vehicle glass moving switch for opening a vehicle window glass manually at a first stroke switching operation and automatically at a second stroke switching operation when said operating knob is pivoted in a first direction and closing the vehicle window glass manually at a first stroke switching operation and automatically at a second stroke switching operation when said operating knob is pivoted in a second direction opposite to the first direction.

* * * * *

UNITED STATES PATENT AND TRADEMARK OFFICE

CERTIFICATE OF CORRECTION

PATENT NO. : 5,115,108

DATED : May 19, 1992

INVENTOR(S) : Kikuo OGAWA et al

It is certified that error appears in the above-identified patent and that said Letters Patent is hereby corrected as shown below:

Column 5, line 39, "release" should be --released--.

IN THE CLAIMS:

Column 9, Claim 3, line 16 of claim 3, "first" should be --second--; and lines 17 and 18 of claim 3, "and automatically at a second stroke switching" should be --when said operating knob is pivoted in a second--.

Signed and Sealed this

Twenty-fourth Day of August, 1993

Bruce Lehman

*Attest:*

BRUCE LEHMAN

*Attesting Officer*

*Commissioner of Patents and Trademarks*